US007600758B1

(12) United States Patent
Nies

(10) Patent No.: US 7,600,758 B1
(45) Date of Patent: Oct. 13, 2009

(54) CARD GAME

(76) Inventor: David Nies, 857 Summerhill Dr., Aurora, IL (US) 60506

( * ) Notice: Subject to any disclaimer, the term of this patent is extended or adjusted under 35 U.S.C. 154(b) by 145 days.

(21) Appl. No.: 12/004,553

(22) Filed: Dec. 22, 2007

(51) Int. Cl.
*A63F 1/00* (2006.01)

(52) U.S. Cl. ..... 273/292; 273/303; 273/274

(58) Field of Classification Search ..... 273/292, 273/274, 309, 303–306; 463/13, 12
See application file for complete search history.

(56) References Cited

U.S. PATENT DOCUMENTS 5,324,041 A * 6/1994 Boylan et al. ..... 273/292
5,813,673 A * 9/1998 Richardson ..... 273/292
6,102,403 A * 8/2000 Kaufman ..... 273/292
6,439,573 B1 * 8/2002 Sklar ..... 273/292
2003/0104852 A1 * 6/2003 Duhamel ..... 463/13

* cited by examiner

*Primary Examiner*—Benjamin H Layno
(74) *Attorney, Agent, or Firm*—Robert L. Marsh

(57) ABSTRACT

A card game has several groups of cards with the cards of each group identified by a common color and the cards of each of the groups are successively numbered. A player is given four cards face down and four cards in his hand. In a play of the cards, a player displays one card from his hand and selects one of his face down cards to play it against. The player declares whether the displayed card is higher or lower than the selected card and wins points if his declaration is correct.

7 Claims, 3 Drawing Sheets

25

28

29

CARD GAME

The present invention relates to card games and in particular to a game played without a board by two to eight players.

BACKGROUND OF THE INVENTION

Although card games are common, there is an ongoing need for new games requiring a combination of skill and good fortune that are distinctly different from those currently available.

SUMMARY OF THE INVENTION

Briefly, the present invention is embodied in a card game which in its preferred embodiment consists of eighty-four cards broken down into six groups of twelve cards each where each of the groups of cards is distinct from any other group by virtue of color and the twelve cards of each group bear a distinct numeral, the numerals commencing with the number one and extending successively to the number twelve. For the purpose of valuing the cards during play, the cards numbered one through six have a value of five and the cards numbered seven through twelve have a value of ten. In addition to the six groups of twelve cards, the game includes six BUST cards. Each BUST card has no value and when played the BUST card cancels the value of any other card involved in the same play as the BUST card. In addition to the six groups of twelve and the BUST cards, the game includes six BONUS cards where the use of a bonus card in a play of cards is worth twenty-five points to the player. The game further includes a set of rules. In accordance with the rules, the eighty-four cards are stacked face down into a single deck and shuffled. Four cards are directed face down to each of the players of the game and four more cards are directed into a hand for each player, the cards of the hand being visible only to the player holding the hand and to no other player. The remainder of the deck is accessible to all players as a draw stack. The top card is turned over to commence a discard pile.

A first player commences the game by drawing into his hand a card from either the stack or the discard pile. The first player then displays one card from his hand and offers it for play against a card selected from his own four face down cards and declares whether the number born by the displayed card is numerically higher or lower than the number born by the selected face down card. The displayed card and the selected card form a set of cards of a single play. After declaring whether the displayed card is "HI" or "LOW," the first player displays to all players the face of the selected card. If the first player has declared the displayed card to be numerically higher in value than the numeric value of the selected card and his displayed card is in fact numerically higher in value than the numeric value of the selected card, the player is awarded the points assigned to the cards as set forth above. If the player has declared his displayed card to be numerically lower in value than the numeric value of the selected card and his displayed card is in fact numerically lower in value than his selected card, the player is again awarded the points as assigned above to the cards. If the first player has declared his displayed card to be numerically higher than the selected card and in fact the displayed card is not numerically higher than the selected card, or if the player has declared the displayed card to be numerically lower than the selected card and in fact in the displayed card is not numerically lower than the selected card, no points are awarded to the player. At the completion of the play, the first player selects one of the remaining cards from his hand and deposits it face up on the discard pile.

Thereafter, successive players commence a play by drawing a top card from either the remaining cards of the stack or the discard pile and placing the drawn card into his had. The successive player then displays to other players the face side of one card held in his hand and offers it for play against a selected one of his face down cards. The displayed card and the selected card form a set of cards of a dingle play. The successive player then declares whether the numeric value of the displayed card is higher than, HI, or lower than, LOW, as compared to the numeric value of the selected card after which the selected card is turned over and the numeric value on its face displayed to all players. Where the player has declared the displayed card to be numerically higher in value than that of the numeric value of the selected card and the numeric value of the displayed card is in fact greater than the numeric value of the selected card, points are awarded and where the player has declared the displayed card to be numerically lower in value than that of the selected card and the numeric value of the displayed card is in fact lower than that of the selected card, points are awarded. Where the player declared the numeric value of the displayed card to be higher than that of the selected card and the numeric value of the displayed card is not higher than that of the selected card, no points are awarded. Similarly, where the successive player has declared the numeric value of the displayed card to be lower than that of the selected card and the numeric value of the displayed card is not in fact lower than that of the selected card, no points are awarded. At the end of the play, the successive player selects one of the remaining cards from his hand and deposits it face up on the discard pile ending his play. Where any player including the first player has played a BONUS card, either from his hand or by virtue of it being a selected card of the face down cards before him which was revealed during the course of its play, the BONUS card is considered to be either numerically higher or lower in value than the numeric value of the selected card as best benefits the player, and the player is entitled to the points assigned to both cards of the set in determining the point value of the play.

At any time during the course of a play, a player may deposit a BUST card on a set of cards from a previous play made by any other player. After depositing a BUST card on the set previously played the points accumulated by the other player during the play of the set for which a BUST card has been deposited are canceled. A player who has played a BUST card will then draw a second card from either the remaining cards in the stack or the discard pile to replace the BUST card, and his play ends with the deposit on the discard pile of one of the cards remaining in his hand.

Each successive player makes a play of the cards, the play commencing by selecting a top card from either the remaining cards of the stack or the discard pile, displaying one card from the player's hand and playing the displayed card against a selected card of the remaining face down cards before him, winning or losing the points of the cards played, sometimes playing a BUST card on a group of cards previously played by another player, and the play ending by discarding a card from his hand onto the discard pile. After all the players have successively played all the cards in their hands, the points accumulated by each are added together. The victorious player is the player having either the most accumulated points or the player who first reached a predetermined goal, such as five hundred points.

BRIEF DESCRIPTION OF THE DRAWINGS

A better understanding of the invention will be had by a reading of the following detailed description taken in conjunction with the drawings wherein.

DETAILED DESCRIPTION OF A PREFERRED EMBODIMENT

Figure 1:
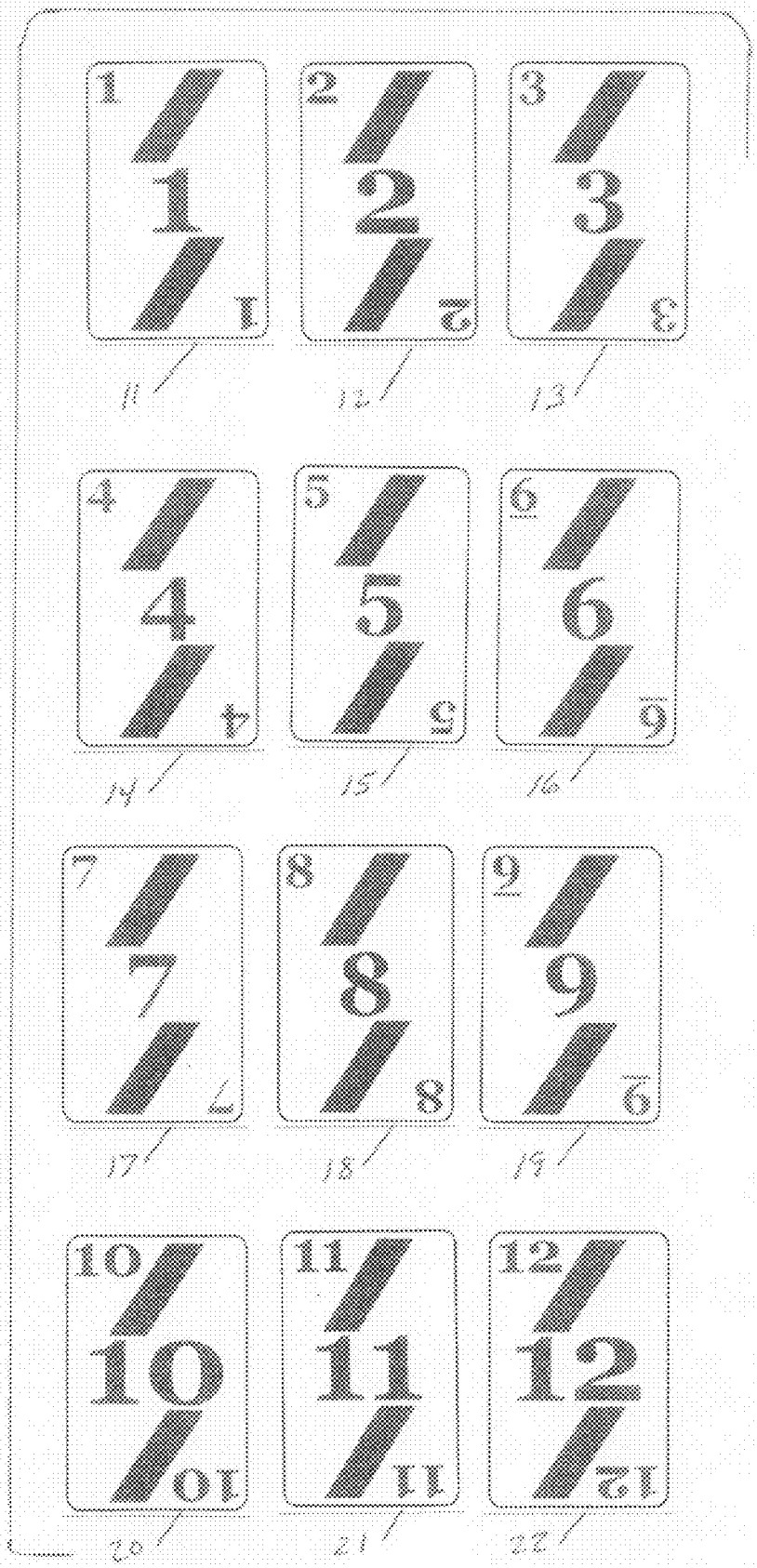
FIG. 1 is a front elevational view of the face side of twelve cards that make up one group of value cards.

Referring to FIG. 1, the game of the present invention is played by at least two players and preferably no more than six. The object of the game is for each player to acquire as many points as he can before the expiration of the time of the game or to be the first to exceed a certain threshold number of points such as five hundred points. In its preferred embodiment, the game is played with eighty-four cards, including six groups of twelve cards each, six BONUS cards and six BUST cards. All cards have a back side and a face side with the face side bearing a number, symbol, or word that designates the numerical value of the card. All back sides of the cards are identical so that the value of the face side of a card cannot be determined by viewing the back side thereof. The six groups of cards are distinguishable from one another by the color applied to the numbers or symbols on the face side thereof with the face side of all the cards of one group being of the same color. Any choice of colors may be used, but I have found it satisfactory to choose the colors of red, yellow, blue, green, purple, and orange. The twelve cards 11-22 of one group are depicted in FIG. 1. As can be seen, the face side of each card 11-22 bears a numeric value different from that of any other card in the group. Preferably, the numeric values commence with number 1 and extend successively to number 12 as depicted on the cards 11-22 in FIG. 1

Figure 2:
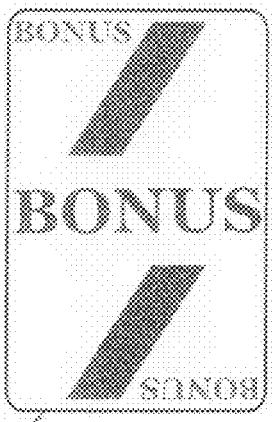
FIG. 2 is a face side view of a BONUS card.
Figure 3:
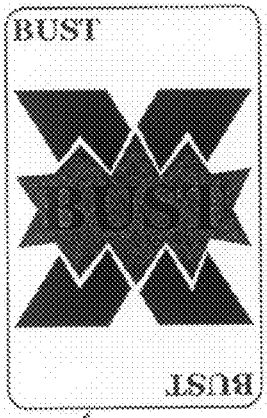
FIG. 3 is a face side view of a BUST card.
Figure 4:
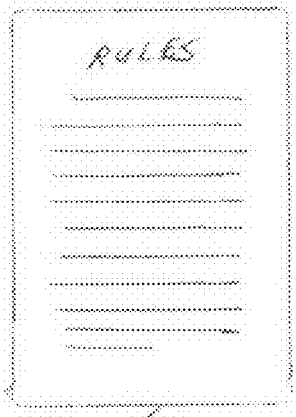
FIG. 4 is a front view of a set of rules for playing a game according to the invention.

Referring to FIG. 2, the six BONUS cards 25 are identical to one another except that each is of a different color with each of the six colors of the BONUS cards being identical to one of the six colors of the six groups of twelve cards. Referring to FIG. 3, the six BUST 28 cards are identical to each other and are indistinguishable from one another. Referring to FIG. 4, the game also includes a set of rules 29 that describe the steps to be followed by each player and the requirements for winning the game.

For the purpose of determining the value of the play of a group of cards, the cards are assigned a point value that may be different from the face value of the cards. I have found that the game is best played by assigning a value of five points to cards bearing numbers 1 through 6, assigning a value of ten points each to cards bearing numbers 7 through 12, and a value of twenty-five points to each BONUS card. It is desirable that the point values of a BONUS card 25 should be substantially grater than the point value of a numbered card so that a player will want to include a BONUS card 25 in a play of cards. Preferably, BUST cards are assigned no points. I have also found that interest is further enhanced when players can win certain additional rewards during the play of the game. For example, the point value for a set of two cards of a play may be doubled when the two cards are the same color. Also, when the two cards of a play bare the same number, the player may be awarded twice the point value of the two cards even though the value of the displayed card is not greater than or less than the value of the selected card as the player has declared.

At the commencement of the game, the cards are arranged with the face sides thereof aligned in the same direction, with the cards stacked face side down and shuffled.

Figure 5:
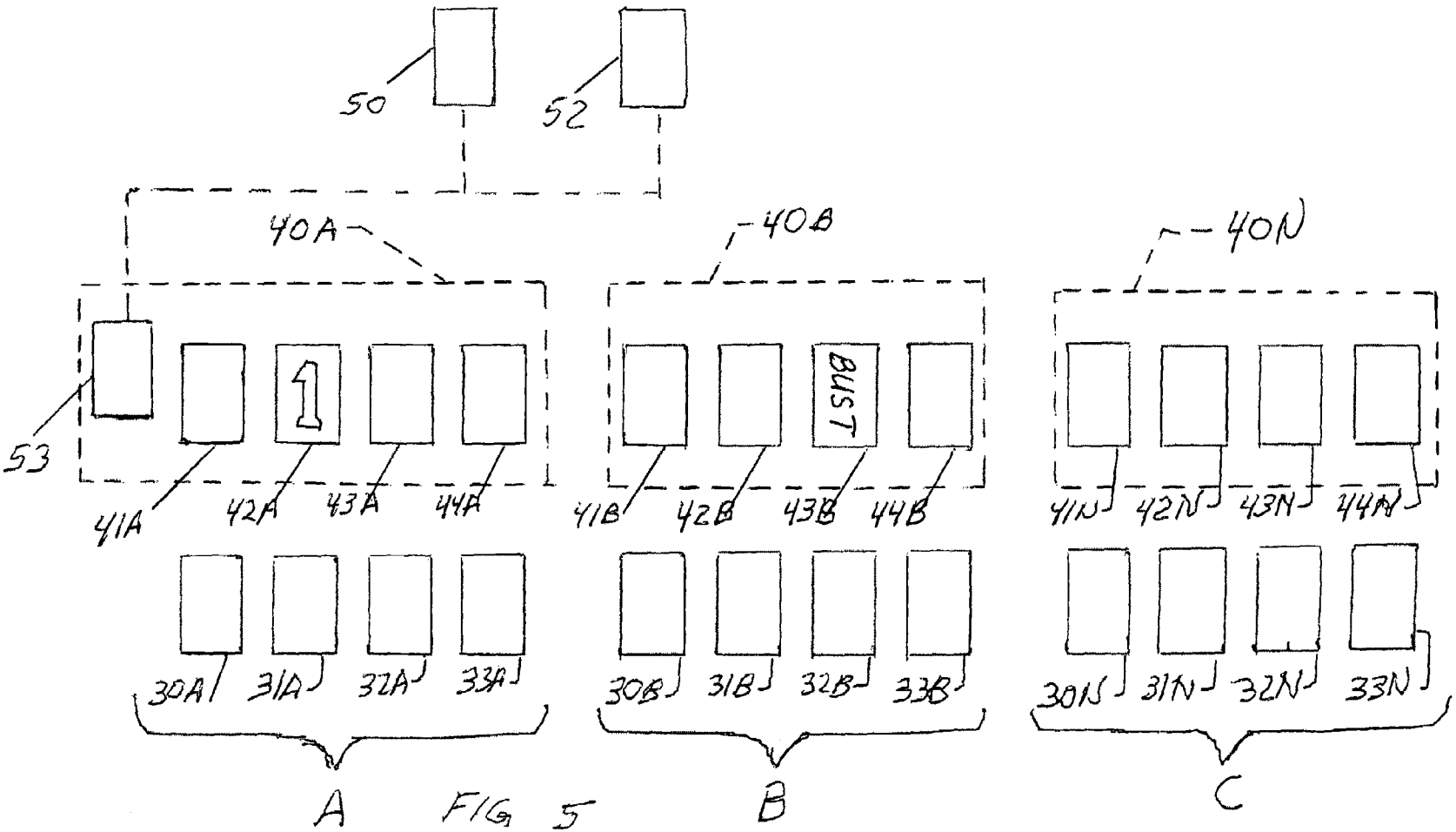
FIG. 5 is an example of the hands of several players before the commencement of play.

Referring to FIG. 5, the cards are dealt with a batch of four face down cards 30A, 31A, 32A, 33A, 30B, 31B, 32B, 33B, . . . 30N, 31N, 32N, 33N to each player A, B, . . . N. Thereafter, each player A, B, . . . N is dealt a batch of four additional cards, 41A, 42A, 43A, 44A, 41B, 42B, 43B, 44B, . . . 41N, 42N, 43N, 44N to form a hand 40A, 40B, . . . 40N with each of the cards of the hand 40A, 40B, . . . 40N being visible only to the player A, B, . . . N receiving the cards, but not to any other player. Thereafter, the stack of remaining cards is retained face down as a draw stack 50 and the top card thereof is turned face side up and separated from the draw stack 50 as the commencement of a discard pile 52.

Thereafter, a first player A commences a play by drawing a top card 53 from one of the stack 50 or the discard pile 52 and adding the drawn card into the cards of his hand 40A such that the hand 40A of a first player A consists of five cards. FIG. 5 depicts a typical arrangement of cards as of the commencement of first play by a first player A. Thereafter, the first player A will display to all the other players of the game the face side of one of the cards 41A, 42A, 43A, 44A, 53 in his hand 40A and align the displayed card with a card selected from the face down cards 30A, 31A, 32A, 33A before him. The displayed card from the player's hand 40A and the selected card from the face down cards 30A, 31A, 32A, 33A then becomes a set of cards that the player has chosen for his play. The first player A then declares whether the numeric value of the displayed card from the player's hand 40A is higher, HI, or lower, LOW, than the numeric value of the selected card. For example, player A may display card 42A which bears the number 1 and select card 30A as the second card of the set for play. After declaring the displayed card to be HI or LOW, the selected card 30A is turned face side up. Where the player has declared the numeric value of the displayed card to be higher than that of the selected card and in fact the numeric value of the displayed card is higher than that of the selected card, the player is awarded the points for the set of cards where the assigned points are as set forth above. Where the player has declared the numeric value of the displayed card to be lower than that of the selected card and the numeric value of the displayed card is in fact lower than that of the selected card, the player is also awarded the points for the set of two cards. Where the player has declared the numeric value of the displayed card to be higher than that of the selected card and the numeric value of the displayed card is not in fact higher than that of the selected card no points are awarded, and where the player has declared the numeric value of the displayed card to be lower than that of the selected card and the numeric value of the displayed card is not in fact lower than that of the selected card, no points are awarded. Thereafter, the first player A ends the play by selecting one of the remaining cards in his hand 40A and depositing it face side up on the discard pile 52.

Where a BONUS card 25 is played, either as a displayed card from a player's hand 40A or as a selected card from one of the down cards 31A, 32A, 33A, 34A, the BONUS card 25 becomes part of the play and the player is awarded the points for both cards of the play into his accumulated score. When the BONUS card 25 is the same color as the other card of the set, I have found that the game is enhanced by awarding double the points of the two cards that make up the set, i.e., double the points of the BONUS card 25 plus double the points of the second card of the set.

Following the completion of a first play by the first player A, a second player B thereafter commences his play by drawing a top card from either the stack 50 or the discard pile 52 and adding it to his hand 40B. The second player B thereafter displays to all the remaining players the face side of one of the cards in his hand 40B and selects one of the remaining cards of his face down cards 30B, 31B, 32B, 33B to be played against the displayed card. He then declares whether the numeric value of the displayed card is higher, HI, or lower, LOW, than the numeric value of the selected card. Thereafter, the selected card is turned face side up and its numeric value compared to that of the displayed card. Where the player has declared the numeric value of the displayed card to be higher than that of the selected card and the numeric value of the displayed card is in fact higher than that of the selected card, he is awarded the points of the set of cards as described above and if he has declared the numeric value of the displayed card to be lower than that of the selected card and in fact the numeric value of the displayed card is lower than that of the selected card, he is again awarded points as described above. Where the player has declared the numeric value of the displayed card to be higher than that of the selected card and in fact the numeric value of the displayed card is not higher than that of the selected card no points are awarded, and if he has declared the numeric value of the displayed card to be lower than that of the selected card and in fact the numeric value of the displayed card is not lower than that of the selected card, no points are awarded.

Where a player draws, or already has in his hand, a BUST card 28, such as card 43B depicted in FIG. 5 with respect to the hand of player B, player B may, during the course of his play, deposit the BUST card 28 upon a set of cards previously played by another player N. When player B deposits his BUST card 28 upon a set of cards of a previous play made by an other player N, the points accumulated by the other player N as a result of the set of cards for which a BUST card 28 has been deposited will have the points of that set canceled and his accumulated points corresponding reduced. After playing the BUST card 28, the player B will draw an additional card from either the stack 50 or the discard pile 52 and continue with the play, the play ending by depositing one of the remaining cards in player B's hand 40B on the discard pile 52.

After the end of each play, a successive player N commences a play by drawing a card from the stack 50 or the discard pile 52, displaying a card from his hand 40N and playing the displayed card against a selected card from his face down cards 30N, 31N, 32N, 33N, declaring whether the numeric value of the displayed card is high or low compared to the numeric value of the selected card and adding to his accumulated points any points awarded by virtue of the play. The hands are played successively through the various players until all the cards of all the players' hands have been played after which the game is repeated. The ultimate winner of the game is the player A . . . N who has accumulated either the most points or is the first player to accumulate a predetermined score such as five hundred points.

Referring to FIGS. 1-4, in its preferred embodiment, the game of the present invention includes six groups of cards 11-22 with the cards of each group numbered 1 through 12 and the cards of a given group identified by a common color, six BONUS cards 25, one BONUS card 25 bearing the color of each of the groups, six BUST cards 28, and a set of rules 29.

While the present invention has been described with respect to a single embodiment, it will be appreciated that many modifications and variations may be made without departing from the spirit and scope of the invention. It is therefore the intent of the appending claims to cover all such modifications and variations that fall within the spirit and scope of the invention.

What is claimed is:

1. A method of playing a card game comprising the steps of providing eighty-four cards wherein said eighty-four cards include six groups of twelve successively numbered value cards, six BONUS cards, and six BUST cards, wherein each of said eighty-four cards has a face side on which is printed all information pertaining to said card, and each card having a back with said backs of all of said plurality of cards being identical, arranging said cards in a shuffled stack with all said face sides directed downwardly, providing a plurality of players, distributing face side down four of said eighty-four cards to each of said plurality of players, said face side down cards not visible to all players, distributing to each of said plurality of players four of said remaining cards wherein face sides of said second four distributed cards are visible only to said player receiving said four second cards and are retained by said payer as a hand, turning face side up a first top card of said eighty-four cards remaining in said stack and spacing said first top card form said stack to form a discard pile, a first of said players commencing a play by drawing a top one of said cards from one of said remaining stack and said discard pile and placing said drawn card in said first players said hand, said first of said players displaying to other players a face side of a first card from his hand wherein said first card is a displayed card, said first player selecting a card from his face down cards for play wherein said face down card is a selected card, said first player declaring whether his said displayed card bears a number that is higher than or lower than a number born by his said selected card, displaying to all players said face side of said first player's selected card, awarding points to said first of said players where said first of said players has declared said displayed card to be higher than his said selected card and said displayed card bears a number that is higher than said selected card, awarding points to said first of said players where said first of said players has declared said displayed card to be lower than said selected card and a number of said displayed cards is lower than a number of said selected card, said first player discarding onto said discard pile one of his cards remaining in his said hand thereby ending said play commenced by said first player, each successive player thereafter commencing a play for such successive player by drawing a top one of said cards from one of said remaining stack of said cards and said discard pile and placing said drawn card into his said hand, said successive player displaying to other players a face side of one card held in his said hand and offering said displayed card for play, said successive player selecting one of his face down cards as a selected card for play against his said displayed card, said successive player declaring whether his said displayed card bears a number that is higher than or lower than a number born by his said selected card, displaying to all players said face side of said successive players said selected card, awarding points to said successive player where said successive player has declared his said displayed card to be higher than his said selected card and said displayed card bears a number that is higher than a number born by his said selected card, awarding points to said successive player where said successive player has declared his said displayed card to be lower than his said selected card and said displayed card bears a number that is lower than a number born by his said selected card, said successive player discarding onto said discard pile one of his cards remaining in his said hand, thereby ending said play commenced by said successive player, awarding additional points to a player who, during the course of his play, displays a BONUS card for play against a selected card selected from his face down cards, canceling all points awarded to a second player during a given previous play when a third player, during said third player's play, displays a BUST card and directs that said BUST card is applied to said given previous play, and declaring one of said players to be a winner of said game where said winning player has accumulated points that are one of more points than any other player, and more than a predetermined number of points.

2. The card game of claim 1 wherein each card of any group of cards is the same color as all other cards in said groups and the cards of no two groups are the same color, each of said BONUS cards is the color of one of said groups of cards with no two BONUS cards having the same color, and said game includes the further step of awarding additional points to a player who plays a numbered card against a BONUS card having the same color as said numbered card.

3. The card game of claim 1 wherein a player plays two BONUS cards against each other, and said game includes the further step of awarding additional points for two BONUS cards being played against each other.

4. The card game of claim 1 wherein each of said cards of each of said groups of cards are numbered "1" through "12."

5. A method of playing a card game comprising the steps of providing a plurality of groups of numbered cards wherein the cards of each of said groups are successively numbered and said cards of each of said groups are distinguishable from said cards of another of said groups, providing a plurality of players, distributing a first batch of a given number of said cards to each of said plurality of players all of said first batch distributed face down and not visible to all players, distributing a second batch of said given number of said cards to each of said plurality of players, each of said second batch distributed so as to be visible to only the player receiving said cards wherein said second batch is retained by each of said players as a hand, one of said players displaying one of his said cards of his said hand, said one of said players selecting one of his said second batch of cards for play, and said one of said players declaring whether a face value of said displayed card is higher than or lower than a face value of said selected card, and displaying said face value of said selected card, and awarding points where said one of said player has declared a face value of said displayed card to be greater than a face value of said selected card and said face value of said displayed card is greater than that of said selected card, and awarding points where said player has declared said face value of said displayed card to be less than that of said selected card and said face value of said displayed card is less than that of said selected card.

6. The game of claim 5 and further comprising the steps of providing at least one BONUS card along with said plurality of groups of numbered cards and awarding a substantially greater number of points where one of said displayed card and said selected card is a BONUS card.

7. The game of claim 5 and further comprising the steps of providing at least one BUST card wherein no points are awarded for a play including said BUST card.

* * * * *